US008434761B2

(12) United States Patent
Ruiz et al.

(10) Patent No.: US 8,434,761 B2
(45) Date of Patent: May 7, 2013

(54) ALTERNATING GROOVED BELTLESS VACUUM TRANSPORT ROLL

(75) Inventors: Erwin Ruiz, Rochester, NY (US); Melissa A. Monahan, Rochester, NY (US); Steven M. Russel, Bloomfield, NY (US)

(73) Assignee: Xerox Corporation, Norwalk, CT (US)

( * ) Notice: Subject to any disclaimer, the term of this patent is extended or adjusted under 35 U.S.C. 154(b) by 40 days.

(21) Appl. No.: 13/020,861

(22) Filed: Feb. 4, 2011

(65) Prior Publication Data

US 2012/0200030 A1 Aug. 9, 2012

(51) Int. Cl.
*B65H 5/02* (2006.01)

(52) U.S. Cl.
USPC ..... 271/276; 271/3.22; 271/3.23; 271/194

(58) Field of Classification Search ..... 271/7, 276, 271/3.22, 3.23, 194; 414/797.8, 797.9
See application file for complete search history.

(56) References Cited

U.S. PATENT DOCUMENTS

| | | | | |
|---|---|---|---|---|
| 4,447,144 | A | 5/1984 | Gibson | |
| 5,004,221 | A * | 4/1991 | Stark | 271/194 |
| 5,127,329 | A * | 7/1992 | DeMoore et al. | 101/420 |
| 5,561,918 | A | 10/1996 | Marschke | |
| 5,706,994 | A | 1/1998 | Welch et al. | |
| 5,857,605 | A | 1/1999 | Welch et al. | |
| 6,024,358 | A * | 2/2000 | Steinberg | 271/101 |
| 6,032,004 | A | 2/2000 | Mirabella, Jr. et al. | |
| 6,125,754 | A * | 10/2000 | Harris | 101/420 |
| 6,270,075 | B1 | 8/2001 | Korhonen et al. | |
| 6,543,760 | B1 * | 4/2003 | Andren | 271/99 |
| 6,824,130 | B1 * | 11/2004 | Sardella et al. | 271/112 |
| 6,873,821 | B2 | 3/2005 | Russel et al. | |
| 7,351,309 | B2 | 4/2008 | Kurki et al. | |
| 7,621,524 | B2 * | 11/2009 | Levin | 271/123 |
| 7,819,519 | B2 * | 10/2010 | Eve | 347/104 |

FOREIGN PATENT DOCUMENTS

| | | |
|---|---|---|
| CN | 2683605 | 3/2005 |
| DE | 102008000055 | 7/2008 |
| FI | 965026 | 6/1998 |
| JP | 5092835 | 4/1993 |
| JP | 7185436 | 7/1995 |

* cited by examiner

*Primary Examiner* — Michael McCullough
*Assistant Examiner* — Howard Sanders
(74) *Attorney, Agent, or Firm* — Gibb & Riley, LLC

(57) ABSTRACT

A sheet transportation apparatus includes at least one beltless vacuum transport (BVT) that has a plurality of adjacent rollers. Each of the rollers comprises a rounded external surface and an axis about which the external surface rotates. The external surfaces of the rollers are spaced from each other by gaps referred to as "inter-roller spaces." A fan is positioned on a first side of the rollers. The fan draws air through the inter-roller spaces to create a vacuum force on a second side of the rollers. The vacuum force maintains the sheets of media in contact with the second side of the rollers. The external surface of each of the rollers comprises a plurality of first regions having a first diameter and a plurality of second regions having a second diameter different than the first diameter. The first regions and the second regions of the external surface are adjacent one another and alternate along the length of the external surface of each of the rollers.

12 Claims, 5 Drawing Sheets

ALTERNATING GROOVED BELTLESS VACUUM TRANSPORT ROLL

BACKGROUND

Embodiments herein generally relate to sheet transportation devices and more particularly to a beltless vacuum transport apparatus that includes grooves in the rollers.

Various devices, such a printers and finishing machines, need to transport sheets. For example, many printing devices transport sheets to and from a marking device to allow the marking device to print markings on the sheet. There are many forms of such sheet transportation devices, including ones that use rolls (which are sometimes referred to herein as rollers), belts, vacuum devices, etc.

SUMMARY

An exemplary sheet transportation apparatus herein can be used in any device that moves sheets of media, such as a printing device that has a media path that moves sheets of media by a marking device. The media path includes at least one beltless vacuum transport (BVT) that has a plurality of adjacent rollers. Rotation of the rollers moves the sheets of media in a process direction.

Each of the rollers comprises a rounded external surface and an axis about which the external surface rotates. Each axis can be parallel to each other axis (if, for example, the BVT is in a straight line) and the axes of the rollers are generally perpendicular to the process direction of the media path. The external surfaces of the rollers are spaced from each other by gaps referred to as "inter-roller spaces."

A fan is positioned on a first side of the rollers. The fan draws air through the inter-roller spaces to create a vacuum force on a second side of the rollers. The vacuum force maintains the sheets of media in contact with the second side of the rollers.

The external surface of each of the rollers comprises a plurality of first regions having a first diameter and a plurality of second regions having a second diameter different than the first diameter. The first regions and the second regions of the external surface are adjacent one another and alternate along the length of the external surface of each of the rollers.

The external surface of each of the rollers further comprises sidewalls connecting the first regions to the second regions. The sidewalls between the first and second regions can be positioned at a right angle to the axis of each roller, so that the sidewalls are parallel to the process direction of the media path. Alternatively, the sidewalls between the first and second regions can be positioned at a non-right angle (obtuse angle or acute angle) to the axis of each roller, so that the sidewalls are not parallel to the process direction of the media path.

The first regions of adjacent rollers are positioned next to one another and the second regions of the adjacent rollers are positioned next to one another. The inter-roller spaces between the first regions of adjacent rollers are greater than inter-roller spaces between the second regions of the adjacent rollers.

These and other features are described in, or are apparent from, the following detailed description.

BRIEF DESCRIPTION OF THE DRAWINGS

Various exemplary embodiments of the systems and methods are described in detail below, with reference to the attached drawing figures, in which.

DETAILED DESCRIPTION

Figure 1:
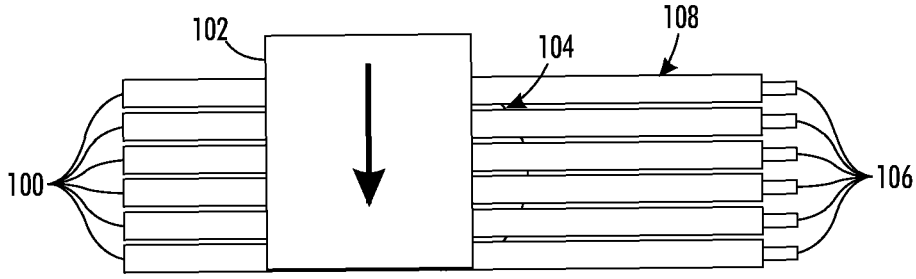
FIG. 1 is a top-view schematic diagram of a BVT device.
Figure 2:
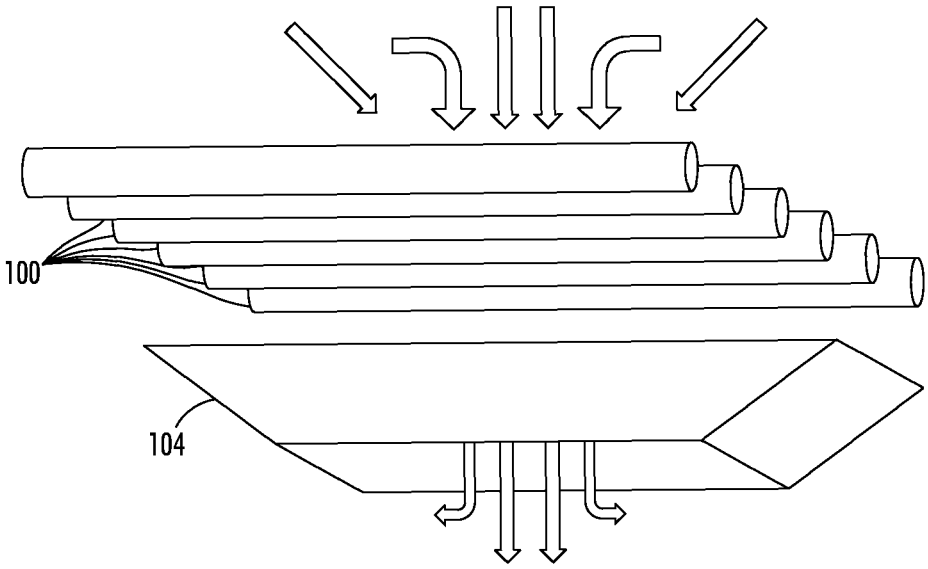
FIG. 2 is a perspective-view schematic diagram of a BVT device.

Beltless vacuum transport systems include a series of rollers mounted in a vacuum chamber box (for a fuller description of conventional BVT systems, see U.S. Pat. No. 6,873,821, the complete disclosure of which is incorporated herein by reference). For example, as shown as FIGS. 1 and 2 such systems can include a series of rollers 100 positioned next to one another transporting a sheet of media 102. The rollers 100 can be made of any material (metals, alloys, plastics, silicon, ceramics, etc.) and include a continuous linear surface 108 from one end of the rollers 100 to the opposite end of the rollers 100. The arrow above the sheet of media 102 indicates the transport direction (sometimes referred to as the process direction).

In the drawings, the side of the rollers 100 that contacts the sheet of media 102 is arbitrarily referred to as the "top" of the structure, and the opposite side of the rollers 100 is referred to as the "bottom" of the structure to simplify the description; however, those ordinarily skilled in the art would understand that the structure is not limited to this orientation and that it could have any orientation appropriate for a given design.

Some form of vacuum producing device 104 is positioned below the bottom of the rollers 100. While this vacuum device 104 is illustrated as a simple rectangular duct, those ordinarily skilled in the art would understand that the vacuum device 104 could have any shape appropriate for a given device and could be positioned at any location relative to the rollers 100. Generally, the vacuum device 104 includes a fan to draw air from the top of the rollers toward the bottom of the rollers 100 (as indicated by the arrows in FIG. 2) and includes some form of casing or ductwork to create a vacuum below the bottom of the rollers 100.

In addition, the BVT system includes one or more drive mechanisms 106 (such as drive motors, etc.) that can rotate the rollers 100. While all the rollers 100 are illustrated as including an individual drive mechanism 106, those ordinarily skilled in the art would understand that less than all the rollers 100 could include the drive mechanisms 106. Further, the drive mechanisms 106 could be linked together through a chain, belt, gears, etc., to allow a single drive motor to simultaneously rotate all the rollers 100. As the rollers 100 rotate, they move the sheet of media 102 in the process direction and the vacuum force from the vacuum device 104 maintains the sheet of media 102 in contact with the rollers 100.

Figure 3:
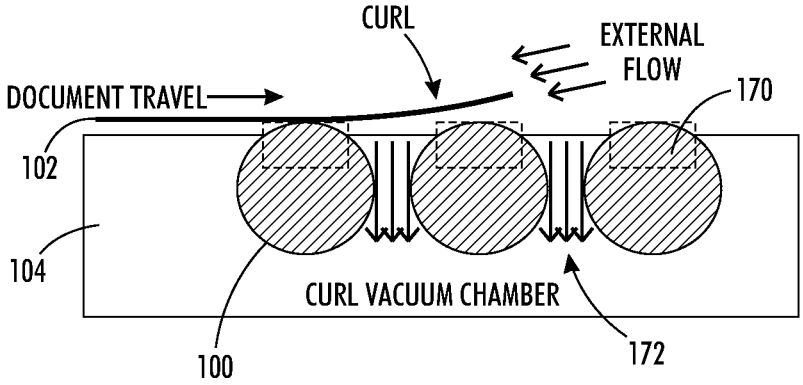
FIG. 3 is a side-view schematic diagram of a BVT device.
Figure 4:
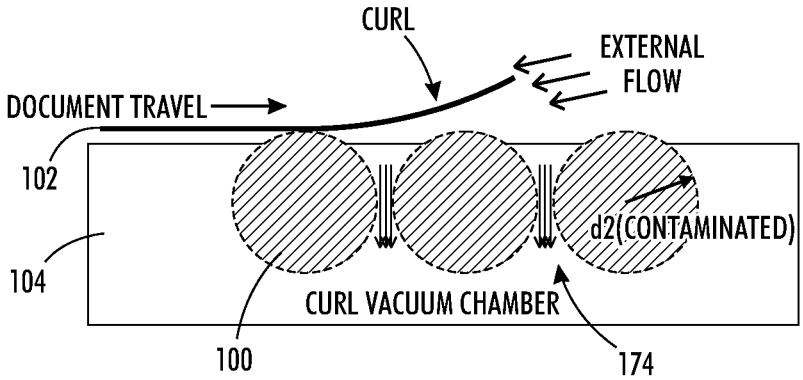
FIG. 4 is a side-view schematic diagram of a BVT device.

As illustrated in FIGS. 3 and 4, one of the major differences between a BVT system and a belt vacuum transport system is that the BVT does not provide a continuous holding force. As shown in FIGS. 3 and 4, the airflow 172 is only acting between the rolls. The holding force is interrupted when the document passes on top of the roll surface 170. This causes the media to be vulnerable to external noises, such as internal machine air flow (external flow). The problem is aggravated when the media has lead edge up-curl, thus making sheet acquisition more difficult. Thus, where the incoming document has up-curl, the sheet lead edge is exposed to external noises (internal machine air flow). The noises decrease the ability of the vacuum air flow 172 to keep the document from fully contacting the roll surfaces 170, and increase the potential of the document flying off the transport.

Another of the dysfunctions of the BVT technology involves the use of silicon material for the rollers 100. Silicon foam material provides great traction at low cost, but this roller material is susceptible to contamination. Loss of document holding force occurs when the diameter (d2) of the rollers 100 increases when silicon material rollers get contaminated with silicon oil, paper dust, and toner particles (see FIG. 4). The porous nature of the open-cell silicon foam surface allows the rollers to absorb these contaminants. This reduces or chokes the airflow 174, as shown in FIG. 4, further reducing the vacuum force applied to the sheet of media 102 and increasing the potential for the sheet of media 102 to fly off the BVT.

While one could make the roll diameter smaller in order to maintain a larger gap between the rolls (and avoid choking the air flow as shown in FIG. 4) such smaller diameter rolls increase paper path trajectory for light weight documents, potentially resulting in jams. Also, lightweight documents easily deflect between the rollers 100, thus overstressing the document traveling on the transport. In addition, the roller material can be changed in order to make the system robust against silicon oil and other contaminants; however, this would increase the cost of the assembly.

In view of such issues, the embodiments herein can provide alternating angled or spiral grooves in the rollers to provide a continuous airflow instead of air flow only between rolls. This provides an air passage regardless of roll diameter changes due to contamination. The angled grooves provide holding force in two axes. The alternating angle between rolls also helps distribute any heat transient to the local area.

Figure 5:
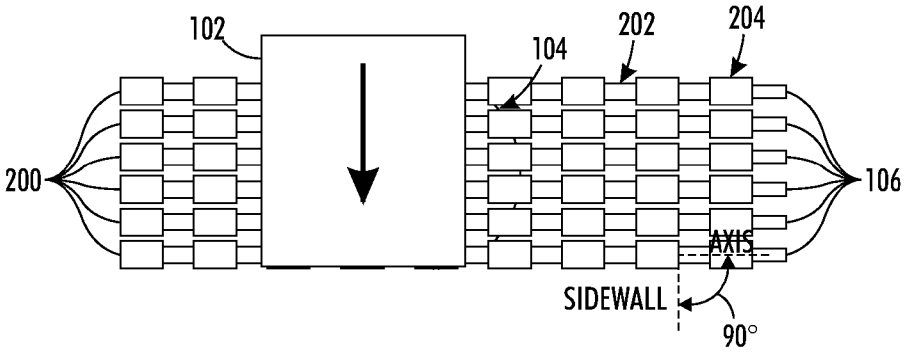
FIG. 5 is a top-view schematic diagram of a BVT device according to embodiments herein.
Figure 6:
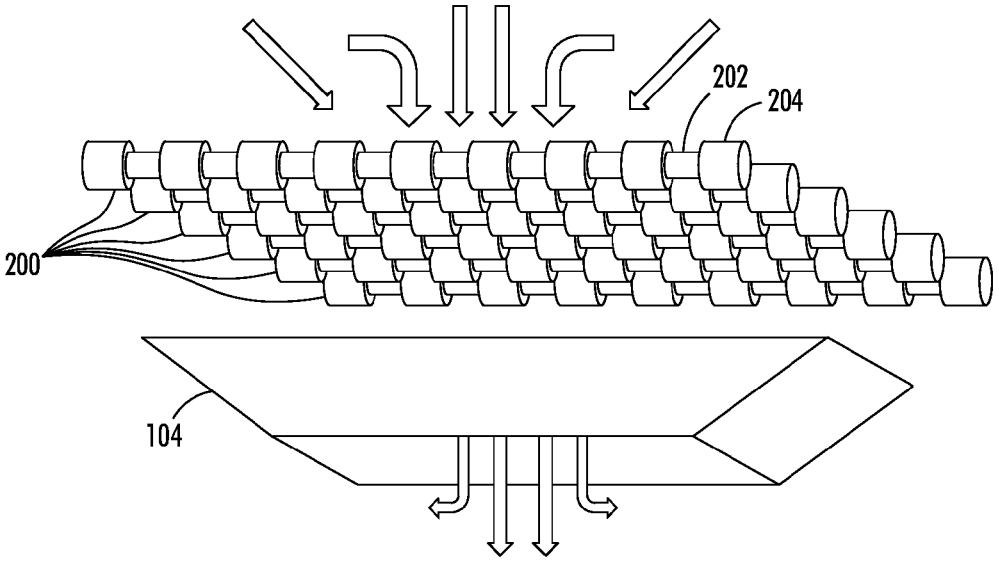
FIG. 6 is a perspective-view schematic diagram of a BVT device according to embodiments herein.

More specifically, as illustrated in FIGS. 5 and 6, each of the rollers 200 comprises a rounded external surface and an axis (axle) about which the external surface rotates. Each axis can be parallel to each other axis (if, for example, the BVT is in a straight line) or can be media path can have a curve. The axes of the rollers 200 are generally perpendicular to the process direction of the media path. The external surfaces of the rollers 200 are spaced from each other by gaps referred to as "inter-roller spaces."

A fan in the vacuum apparatus 104 is positioned on a "first" side (bottom) of the rollers 200. As mentioned above, the fan draws air through the inter-roller spaces to create a vacuum force on a "second" side (top) of the rollers 200. The vacuum force maintains the sheets of media in contact with the second side of the rollers 200.

As shown in FIGS. 5 and 6, the external surface of each of the rollers 200 comprises a plurality of first regions 202 having a first diameter and a plurality of second regions 204 having a second diameter different than the first diameter. As shown, the first regions 202 and the second regions 204 of the external surface are adjacent one another and alternate along the full length of the external surface of each of the rollers 200.

The first regions 202 of adjacent rollers 200 are positioned next to one another and the second regions 204 of the adjacent rollers 200 are positioned next to one another. Thus causes the inter-roller spaces between the first regions 202 of adjacent rollers 200 to be greater than inter-roller spaces between the second regions 204 of the adjacent rollers 200.

The external surface of each of the rollers 200 further comprises sidewalls connecting the first regions 202 to the second regions 204. The sidewalls between the first 202 and second regions 204 can be positioned at a right angle to the axis of each roller, so that the sidewalls are parallel to the process direction of the media path.

Figure 7:
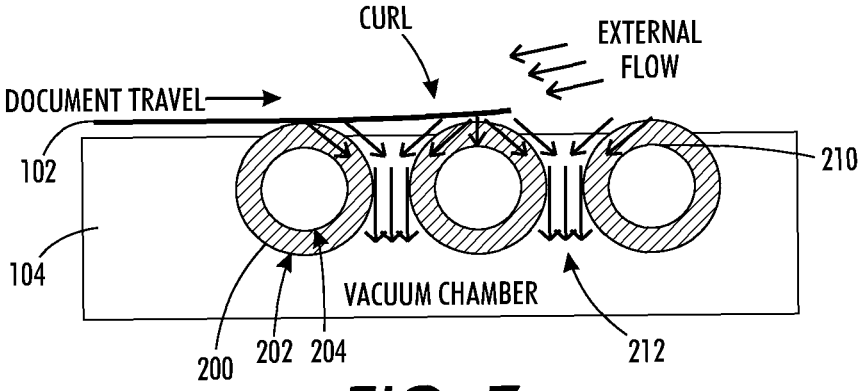
FIG. 7 is a side-view schematic diagram of a BVT device according to embodiments herein.

As shown in FIG. 7, with alternating grooved rolls, the holding force "suction air flow" 212 is now acting continuously on the sheet. Thus, where the incoming document has up-curl, the lead edge is no longer exposed to external noises (internal machine air flows). The document maintains full contact with the top of the roll surface 210, decreasing the potential for fly-off sheets.

Figure 8:
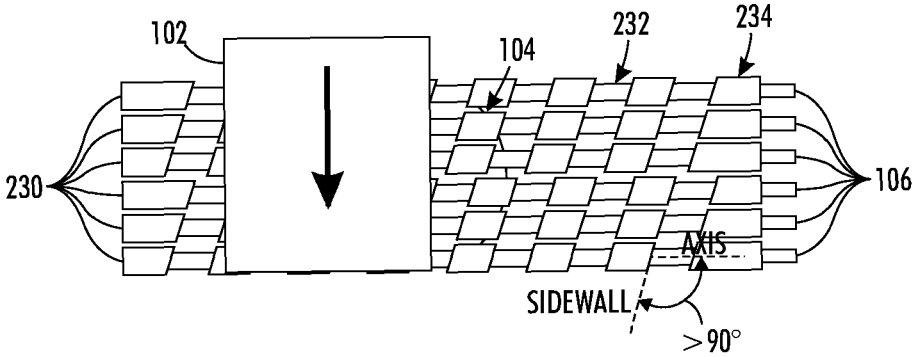
FIG. 8 is a top-view schematic diagram of a BVT device according to embodiments herein.
Figure 9:
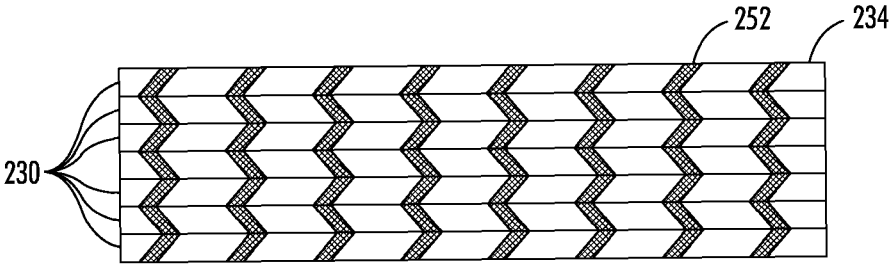
FIG. 9 is a top-view schematic diagram of a BVT device according to embodiments herein.

Alternatively, as shown in FIG. 8, the sidewalls between the first regions 232 and the second regions 234 can be positioned at a non-right angle (obtuse angle or acute angle) to the axis of each roller, so that the sidewalls are not parallel to the process direction of the media path. FIG. 9 illustrates another exemplary structure having grooves 252 (second regions) having angled sidewalls, using an alternating groove pattern.

The grooves created by the difference between the first regions 202/232 and the second regions 204/234 provide a continuous holding force, minimizing the potential effects of external forces acting on document. This increases paper handling robustness. Further, these systems are easy to implement and only require a simple additional machining operation or addition of a feature to the mold (urethane rolls design). The embodiments herein eliminate the sensitivity to silicon oil and other contaminates and the grooves provide a continuous holding force The exemplary sheet transportation apparatus shown in FIGS. 5-9 herein can be used in any device that moves sheets of media, such as a printing device 190 that has a media path 172 including a BVT that moves sheets of media by a marking device 170 (shown in FIG. 10). The printing device 190 can comprise, for example, a printer, copier, multi-function machine, etc.

The printing device 190 can include any form of scanning device, such as one used within a document handler 194 of a printing device 190. The printer body housing 190 has one or more functional components that operate on power supplied from the alternating current (AC) 188 by the power supply 182. The power supply 182 converts the external power 188 into the type of power needed by the various components.

The printing device 190 includes a controller/processor 184, at least one marking device (printing engine) 170 operatively connected to the processor 184, a media path 172 positioned to supply sheets of media from a paper tray 192 to the marking device(s) 170 and a communications port (input/output) 186 operatively connected to the processor 184 and to a computerized network external to the printing device. After receiving various markings from the printing engine(s), the sheets of media pass to a finisher 198 which can fold, staple, sort, etc., the various printed sheets.

Further, the printing device 190 includes at least one accessory functional component, such as the sheet supply/paper tray 192, finisher 198, graphic user interface assembly 196, etc., that also operate on the power supplied from the external power source 188 (through the power supply 182).

The processor 184 controls the various actions of the printing device. A computer storage medium 180 (which can be optical, magnetic, capacitor based, etc.) is readable by the processor 184 and stores the scanned images and instructions that the processor 184 executes to allow the multi-function printing device to perform its various functions, such as those described herein.

Figure 10:
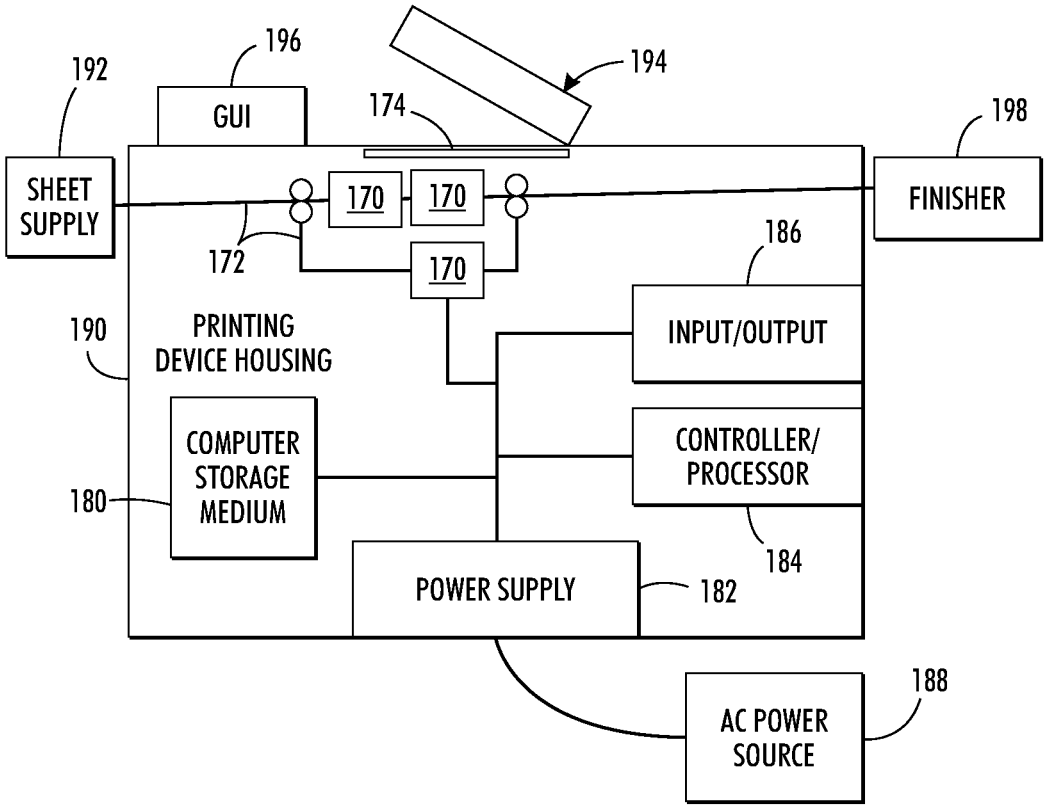
FIG. 10 is a side-view schematic diagram of a printing device according to embodiments herein.

FIG. 10 also illustrates a main platen 174 adjacent to a document handler 194. With this exemplary printing device, items can be placed directly on the main platen 174, or a stack of sheets may be placed within the document handler 194. When the document handler 194 is closed over the main platen 174, the document handler 194 passes in the sheets over the main platen 174.

Many computerized devices are discussed above. Computerized devices that include chip-based central processing units (CPU's), input/output devices (including graphic user interfaces (GUI), memories, comparators, processors, etc. are well-known and readily available devices produced by manufacturers such as Dell Computers, Round Rock Tex., USA and Apple Computer Co., Cupertino Calif., USA. Such computerized devices commonly include input/output devices, power supplies, processors, electronic storage memories, wiring, etc., the details of which are omitted herefrom to allow the reader to focus on the salient aspects of the embodiments described herein. Similarly, scanners and other similar peripheral equipment are available from Xerox Corporation, Norwalk, Conn., USA and the details of such devices are not discussed herein for purposes of brevity and reader focus.

The terms printer or printing device as used herein encompasses any apparatus, such as a digital copier, bookmaking machine, facsimile machine, multi-function machine, etc., which performs a print outputting function for any purpose. The details of printers, printing engines, etc., are well-known by those ordinarily skilled in the art and are discussed in, for example, U.S. Pat. No. 6,032,004, the complete disclosure of which is fully incorporated herein by reference. The embodiments herein can encompass embodiments that print in color, monochrome, or handle color or monochrome image data. All foregoing embodiments are specifically applicable to electrostatographic and/or xerographic machines and/or processes.

In addition, terms such as "right", "left", "vertical", "horizontal", "top", "bottom", "upper", "lower", "under", "below", "underlying", "over", "overlying", "parallel", "perpendicular", etc., used herein are understood to be relative locations as they are oriented and illustrated in the drawings (unless otherwise indicated). Terms such as "touching", "on", "in direct contact", "abutting", "directly adjacent to", etc., mean that at least one element physically contacts another element (without other elements separating the described elements).

It will be appreciated that the above-disclosed and other features and functions, or alternatives thereof, may be desirably combined into many other different systems or applications. Various presently unforeseen or unanticipated alternatives, modifications, variations, or improvements therein may be subsequently made by those skilled in the art which are also intended to be encompassed by the following claims. The claims can encompass embodiments in hardware, software, and/or a combination thereof. Unless specifically defined in a specific claim itself, steps or components of the embodiments herein cannot be implied or imported from any above example as limitations to any particular order, number, position, size, shape, angle, color, or material.

What is claimed is:

1. A sheet transportation apparatus comprising:

a plurality of adjacent rollers, each of said rollers comprising a rounded external surface and an axis about which said external surface rotates, said external surface of said rollers being spaced from each other by inter-roller spaces; and a fan positioned on a first side of said rollers, said fan drawing air through said inter-roller spaces to create a vacuum force on a second side of said rollers, said vacuum force maintaining sheets of media in contact with said second side of said rollers, said external surface of each of said rollers comprising a plurality of first regions having a first diameter and a plurality of second regions having a second diameter different than said first diameter, said first regions comprising angled grooves in said rollers that are at an obtuse angle to said axis, said adjacent rollers comprising said angled grooves positioned at alternating obtuse angles from adjacent roller to adjacent roller, said first regions and said second regions of said external surface being adjacent one another and alternating along a length of said external surface of each of said rollers, said external surface of each of said rollers further comprising parallel sidewalls connecting said first regions to said second regions, and within each of said rollers, all of said sidewalls being parallel to each other.

2. The apparatus according to claim 1, said first regions of adjacent rollers being positioned next to one another and said second regions of said adjacent rollers being positioned next to one another.

3. The apparatus according to claim 1, said inter-roller spaces between said first regions of adjacent rollers being greater than inter-roller spaces between said second regions of said adjacent rollers.

4. The apparatus according to claim 1, each axis being parallel to each other axis.

5. A sheet transportation apparatus comprising:

a plurality of adjacent rollers, each of said rollers comprising a rounded external surface and an axis about which said external surface rotates, said external surface of said rollers being spaced from each other by inter-roller spaces; and a fan positioned on a first side of said rollers, said fan drawing air through said inter-roller spaces to create a vacuum force on a second side of said rollers, said vacuum force maintaining sheets of media in contact with said second side of said rollers, said external surface of each of said rollers comprising a plurality of first regions having a first diameter and a plurality of second regions having a second diameter different than said first diameter, said first regions comprising angled grooves in said rollers that are at an obtuse angle to said axis, said first regions and said second regions of said external surface being adjacent one another and alternating along a length of said external surface of each of said rollers, said external surface of each of said rollers further comprising parallel sidewalls connecting said first regions to said second regions, and within each of said rollers, all of said sidewalls being parallel to each other.

6. The apparatus according to claim 5, said first regions of adjacent rollers being positioned next to one another and said second regions of said adjacent rollers being positioned next to one another.

7. The apparatus according to claim 5, said inter-roller spaces between said first regions of adjacent rollers being greater than inter-roller spaces between said second regions of said adjacent rollers.

8. The apparatus according to claim 5, each axis being parallel to each other axis.

9. A printing apparatus comprising:

a marking device; and a media path adjacent said marking device, said media path moving sheets of media by said marking device, said media path comprising:

a plurality of adjacent rollers, each of said rollers comprising a rounded external surface and an axis about which said external surface rotates, said external surface of said rollers being spaced from each other by inter-roller spaces; and a fan positioned on a first side of said rollers, said fan drawing air through said inter-roller spaces to create a vacuum force on a second side of said rollers, said vacuum force maintaining sheets of media in contact with said second side of said rollers, said external surface of each of said rollers comprising a plurality of first regions having a first diameter and a plurality of second regions having a second diameter different than said first diameter, said first regions comprising angled grooves in said rollers that are at an obtuse angle to said axis, said first regions and said second regions of said external surface being adjacent one another and alternating along a length of said external surface of each of said rollers, said external surface of each of said rollers further comprising parallel sidewalls connecting said first regions to said second regions, and within each of said rollers, all of said sidewalls being parallel to each other.

10. The printing apparatus according to claim 9, said first regions of adjacent rollers being positioned next to one another and said second regions of said adjacent rollers being positioned next to one another.

11. The printing apparatus according to claim 9, said inter-roller spaces between said first regions of adjacent rollers being greater than inter-roller spaces between said second regions of said adjacent rollers.

12. The printing apparatus according to claim 9, each axis being parallel to each other axis.

* * * * *